United States Patent [19]

Petersen

[11] Patent Number: 4,535,714

[45] Date of Patent: Aug. 20, 1985

[54] RUDDER ROTOR FOR WATERCRAFT AND FLOATING EQUIPMENT

[75] Inventor: Fred Petersen, Hamburg, Fed. Rep. of Germany

[73] Assignee: Firma Jastram-Werke GmbH KG, Hamburg, Fed. Rep. of Germany

[21] Appl. No.: 90,042

[22] Filed: Oct. 31, 1979

[30] Foreign Application Priority Data

Nov. 30, 1978 [DE] Fed. Rep. of Germany ..... 2851733

[51] Int. Cl.[3] ..... B63H 25/40

[52] U.S. Cl. ..... 114/162; 114/144 R; 416/4; 244/10; 244/206

[58] Field of Search ..... 114/162, 144 A, 169, 114/144 R, 126; 310/67, 87; 244/10, 21, 206; 416/4

[56] References Cited

U.S. PATENT DOCUMENTS

| | | | |
|---|---|---|---|
| 393,192 | 11/1888 | Thayer | 310/67 R |
| 624,531 | 5/1899 | Painton | 114/162 |
| 3,433,986 | 3/1969 | Arutunoff | 310/87 |
| 3,448,714 | 6/1969 | Brooks | 114/162 |
| 3,806,744 | 4/1974 | Abraham | 310/67 R |
| 3,972,301 | 8/1976 | Protta | 114/162 |
| 4,121,127 | 10/1978 | Adelski | 310/87 |

FOREIGN PATENT DOCUMENTS

| | | | |
|---|---|---|---|
| 494093 | 10/1938 | United Kingdom | 114/144 R |

*Primary Examiner*—Trygve M. Blix
*Assistant Examiner*—Thomas J. Brahan
*Attorney, Agent, or Firm*—Toren, McGeady, Stanger, Goldberg & Kiel

[57] ABSTRACT

The invention relates to an electric rudder rotor which in its simplest construction is in the form of an externally running underwater electric motor and comprises a fixed stator and a rotating rotor, which carries the rotor cylinder, the stator being supplied with electric current and the rotor being rotated by magnetic interaction between the stator and the rotor.

13 Claims, 6 Drawing Figures

RUDDER ROTOR FOR WATERCRAFT AND FLOATING EQUIPMENT

BACKGROUND OF THE INVENTION

The invention relates to a rudder rotor for watercraft and floating equipment.

It is known that with rudders for watercraft and floating equipment approximately two thirds of the rudder action is produced on the suction side and approximately one third on the pressure side. Depending on the width to height ratio of the rudder and the arrangement in the rudder outside the propeller race a suction side separation occurs with a 15° to 35° rudder angle and the suction side action largely collapses. Driven rotors have proved satisfactory in preventing this and they are located either in the leading edge of the rudder or within the bends of multipart rudders (German Patent Application No. 28 20 355, German Pat. No. 420 840).

The hitherto constructed rudder rotors have either been driven mechanically or with a hydraulic motor, the supply line being passed through the hollow-drilled rudder post.

It is naturally very complicated to mechanically drive a rudder rotor through a hollow-drilled rudder post and requires a degree of manufacturing precision which can scarcely be obtained in ship building, so that such a drive is correspondingly expensive.

A drive by a hydraulic motor arranged in the rudder plate is considerable less complicated and costly, although problems are encountered in placing the necessarily very thick hydraulic pipes through the hollow-drilled rudder post and in the actual rudder body. This is particularly the case if account is taken of the fact that the rudder must be rapidly and easily assemblable and disassemblable so as not to unnecessarily impede maintenance and repair work on the propeller or propeller shaft. In addition, considerable flow resistances result from the large number of bends necessary in the hydraulic lines. In installed systems over 60% of the power supplied to the steering engine room is lost in the hydraulic lines. A further disadvantage of the hydraulic rotor drive is the risk of leaks, which can only be repaired when the ship is docked.

BRIEF SUMMARY OF THE INVENTION

The problem of the present invention is to provide a rudder rotor which can be installed in a rudder plate with maximum simplicity and without making high demands regarding the manufacturing precision of the ship building connections. Its energy supply must be uncomplicated and must be constructed so that only limited losses occur. The rudder rotor must be robust and not prone to faults, whilst impeding to the minimum the assembly and disassembly of the rudder plate.

According to the invention this problem is solved by a rudder rotor constructed as an externally running underwater electric motor.

The continuous shaft of the central stator of the rotor can be fixed at the top and bottom to the rudder plate with a good clearance and optionally also elastically or in an articulated manner. This connection essentially need only be torsion-resistant with respect to the degree of freedom of rotation of the stator about its own longitudinal axis in order to serve as an abutment for the torque of the running motor, whilst said torsional resistance need only be provided on one side of the rotor, i.e.

either at the top or the bottom. There is naturally no need for the torque resistance to be rigid and can instead have a certain elasticity. Thus, the rotor can also be mounted in a completely elastic manner in the rudder plate, so that distortions do not occur even in the case of a relatively little manufacturing precision of the connections, whilst in addition it is possible to achieve vibration absorption in both directions, both from the rudder blade to the rotor and from the rotor to the rudder blade. In the case of particularly nonrigid suspension of the rotor, e.g. in vibration mount elements, it is even possible to reduce the starting pulse and therefore the switch-on peak.

An electric rudder rotor constructed in this way can be prefabricated and then installed as a closed unit in the rudder blade, without further construction work being necessary.

The supply of electricity via an electric cable certainly constitutes a considerable improvement compared with the hitherto known solutions. It is robust, not prone to faults and leads to very low losses. A cable is easy to lay and comparatively thin, which is important for drilling in the rudder post. Furthermore with an electric cable it is also possible to consider other power transmission routes than through the hollow-drilled rudder post. As an electric cable is very flexible it can e.g. be passed out of the hull alongside the rudder post, then placed round the latter in the form of a loose coil and then introduced into the rudder plate.

An electric rudder rotor according to the present invention constitutes the simplest and least expensive solution of the present problem. In addition, it operates reliably and requires no maintenance for a very long time. The rotor or the rotor system can be inexpensively manufactured and can be used not only in rudders, but anywhere where rotors are used for flow control purposes.

There are numerous possibilities for designing an electric motor. In principle any machine which receives electric power via a fixed shaft journal and in which its own outer casing is driven is suitable.

Advantageous embodiments of the invention can be gathered from the subclaims.

BRIEF DESCRIPTION OF THE DRAWINGS

The invention is described in greater detail hereinafter relative to exemplified embodiments and the attached drawings, wherein show.

DETAILED DESCRIPTION OF THE PREFERRED EMBODIMENTS

Figure 1:
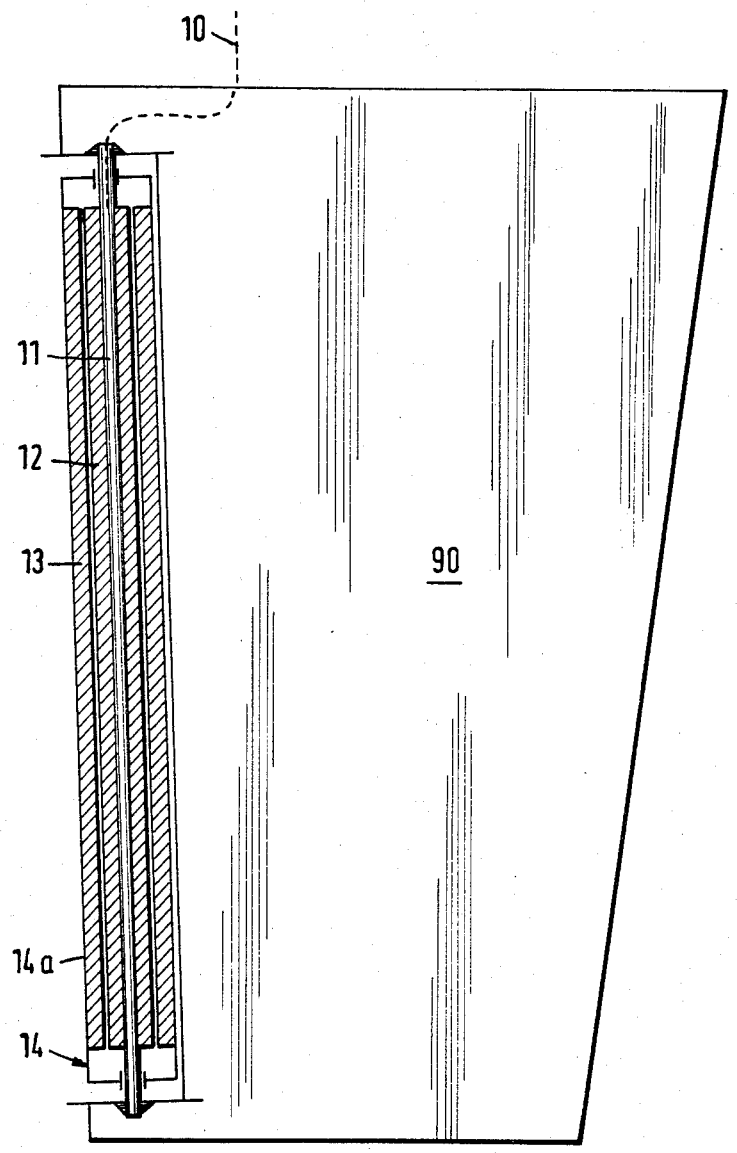
FIG. 1 an electric rudder rotor arranged in the leading edge of a rudder plate, partly in side view and partly in vertical section.

In the embodiment shown in FIG. 1 a rudder rotor is constructed as an externally running underwater electric motor. At the top and bottom a continuous stator shaft 11 is connected with a rudder plate 90 so as to be stiff against torsion, i.e., fixed so so as to be nonrotatable relative thereto. Possibilities for the construction of connections have been described hereinbefore. On the stator shaft 11 is located the actual stator 12, which is supplied with electric power via an electric cable 10, whilst the actual rotor is 13. Rotor 13, which is constructed as a short-circuited rotor is driven. Furthermore rotor 13 is mounted directly on the inside of the rudder rotor cylinder 14*a*.

However, such a construction requires two expensive seals, one on each rotor end to protect against sea water and they wear in time. Furthermore the electromotive parts, i.e. the stator and rotor, generally far from fill the complete overall rotor length, so that in the embodiment of FIG. 1 a long and correspondingly flexible stator shaft is obtained.

Figure 2:
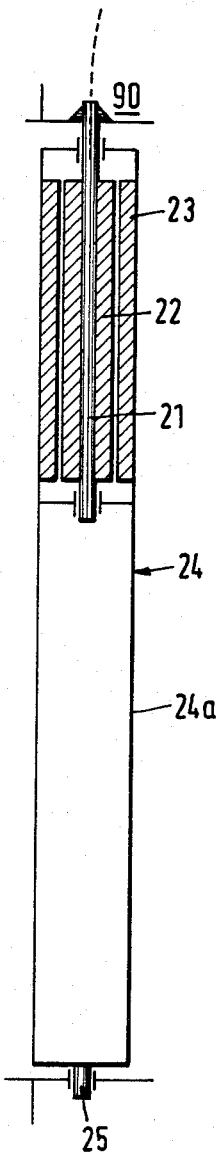
FIG. 2 an electric rudder rotor in which the stator shaft is only passed out of the motor on one side, whilst on the other side the rotor is mounted in rotary manner in the rudder plate, partly in side view and partly in vertical section.

However in the embodiment according to FIG. 2 the rotor 24 is mounted directly on either side of the electromotive part on a short shaft 21 of stator 22, so that stator 22 and rotor 23 are fixed in the best possible way relative to one another. However, in this case a further bearing 25 in rudder plate 90 is required for the lower end of rotor cylinder 24*a*. Naturally all the rotors shown can be installed when rotated by 180°. This bearing can advantageously be constructed, e.g. as a water-lubricated friction bearing.

Figure 3:
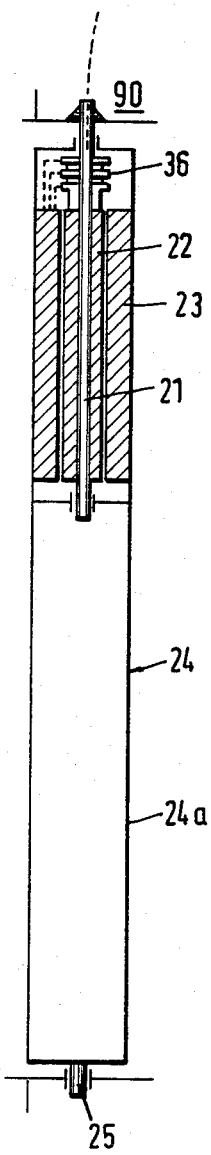
FIG. 3 another embodiment corresponding to FIG. 2, but using the reverse principle of a slip ring rotor, partly in side view and partly in vertical section.

The embodiment of FIG. 3 corresponds in all its functions to that of FIG. 2, except that the electrical actions of stator 22 and rotor 23 have been interchanged, i.e. in this case rotor 23 is supplied with power. Power is supplied via slip rings 36. The advantage of this construction is that to a large extent components of commercial internally running electric motors can be used.

Figure 4:
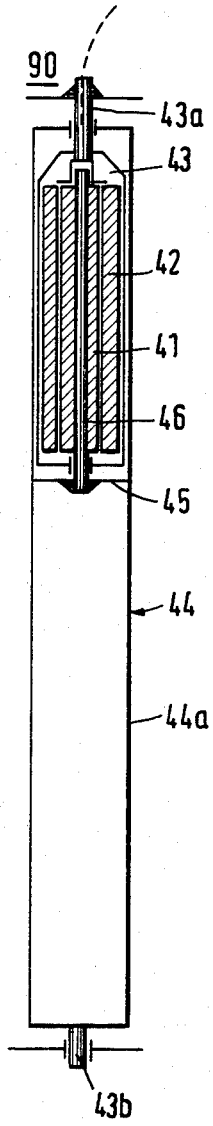
FIG. 4 an electric rudder rotor in which the inner rotor of the motor part rotates as with a normal internally running electric motor and drives the rudder rotor casing, whilst the stator is stationary partly in side view and partly in vertical section.

The principle of conventional internal running electric motors has been retained to an even greater extent in the embodiment of FIG. 4, where the power supply takes place directly to stator 42. Rotor 41 rotates in stator 42 and drives cylinder 44*a* of rudder rotor 44 via its shaft 46 and a flange 45. In this embodiment the rotor cylinder 44*a* is fixed to the lower end of shaft 46 of rotor 41 and by its lower end is mounted via a shaft journal 43*b* in rudder plate 90. The upper end of rotor cylinder 44*a* is mounted on a shaft 43*a*, whose upper end is fixed to rudder plate 90, whilst the lower end is connected to member 43 which receives stator 42 and in which is mounted the upper end of rotor shaft 46. Rotor 41 is arranged in rotary manner in stator 42, whilst the shaft 43*a* connected to member 43 is passed through the casing of rudder rotor 44 and is fixed to rudder plate 90.

It is relatively simple to integrate a reduction gear into the embodiment of FIG. 4 and this can be very useful. A high speed of rotation has no influence on the desired effect, but it is reflected by the third power in the power consumption. To this extent a solution with an integrated reduction gear is very advantageous.

It is naturally possible to use numerous gear constructions. Various planetary gear types would be advantageous in the present case. However, it is also possible to use spur gears and FIG. 5 shows one of the many possibilities.

Figure 5:
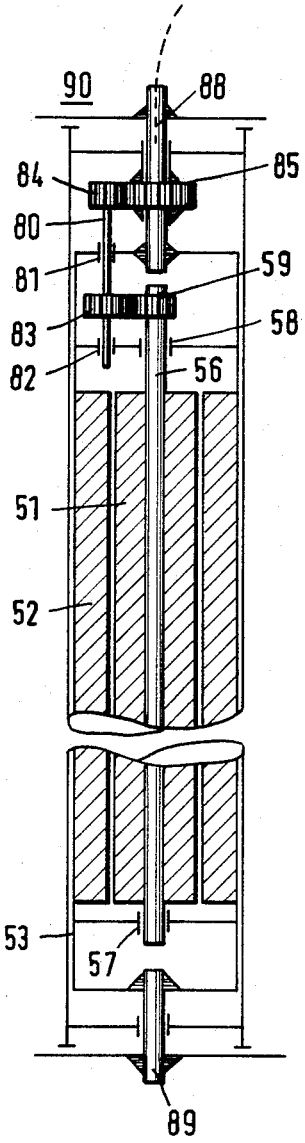
FIG. 5 an electric rudder rotor with an integrated reduction gear in vertical section.

In the case of the embodiment of FIG. 5 the internally running short-circuited rotor 51 rotates in the area of the surrounding windings of stator 52. Stator 52 is fixed to a member 53. At both ends it carries the shaft ends 88, 89 fixed to rudder plate 90 and which are terminally passed out of the rotor cylinder. The inner area of the rotor contains both the bearings 57, 58 for rotor 51 and bearings 81, 82 for the gear shaft. Rotor shaft 56 transmits the torque via a pinion 59 to a gear 83, which in turn rotates gear 85 via a gear shaft 80 and a pinion 84. Gear 85 is rigidly connected to the outer casing of the rotor, so that mounted on the fixed shaft ends 88, 89 the latter must also rotate.

Figure 6:
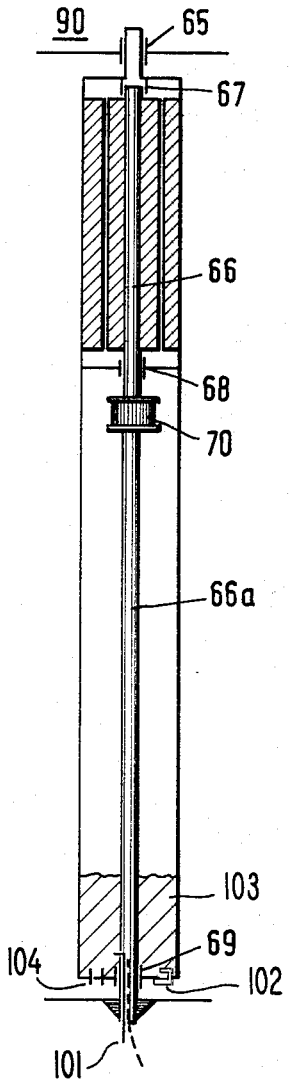
FIG. 6 an electric rudder rotor which is completely closed at the top, so that the electromotive part arranged at the top in the rotor cannot be flooded due to the air bubble which has formed through water penetrating from below, partly in side view and partly in vertical section.

FIG. 6 shows a construction in which the electromotive parts are protected particularly well against the surrounding sea water. In this case the friction bearing 65 is positioned at the top, so that the rudder rotor can be sealed at the top in a completely air-tight manner. The electromotive part is arranged at the top of the rotor.

In the case of the rudder rotor shown in FIG. 6 the driving principle of the rudder rotor shown in FIG. 2 is used. However, it is also possible to use other operating principles described hereinbefore. The important point is that in the case of water 103 penetrating the inner area of the rotor, which can only take place at bearing 69, an air bubble is formed at the top of the rotor and protects from water the electromotive parts located there. It is also conceivable to construct the lower bearing 69 as a water-lubricated friction bearing and then to completely eliminate a separate seal at this point. In addition the rotor can be blown out every so often by means of a separate line 101 or only once by a diver using compressed air when the ship is in the water, so that the atmospheric pressure within the rotor already roughly corresponds to the static pressure of the surrounding water, without a large quantity of water having to penetrate from below into the rotor before pressure balance occurred. The water can be blown out through an open hole 104 or by removal of a plug 102. In principle it is then only necessary to seal against spray water the motor part arranged at the top of the rotor—in FIG. 6 approximately at bearing 68.

In the case of the embodiment of FIG. 6 an elastic member 70 is inserted in the continuous shaft 66, 66*a* in order to absorb misalignments of the three bearings 67, 68, 69. This elastic member can be a vibration mount, but can also be constructed as a geared coupling or the like. The important thing is that it does not transmit any significant bending moment.

The invention is not limited to the embodiments described and represented hereinbefore and various modifications can be made thereto without passing beyond the scope of the invention.

What is claimed is:

1. In a rudder assembly for watercraft and floating equipment including a rudder plate and a rudder rotor mounted on said rudder plate, said rudder rotor including rotating external surface means, the improvement comprising that said rudder rotor is itself constructed as an electric motor to include components forming said rudder rotor as an underwater electric motor consisting essentially of a motor stator and a motor rotor operative to rotatively drive said rotating external surface means, said motor stator and said motor rotor being physically completely contained within the structure of said rudder rotor, said assembly further comprising power supply means extending externally of said rudder rotor for supplying power to drive said electric motor, and wherein the inner area of said rudder rotor is sealed in an air-tight manner at the top and has no seal towards the bottom.

2. A rudder assembly according to claim 1 wherein said rotating external surface means are defined by a rotor cylinder mounted on said motor rotor to be rotatively driven thereby.

3. A rudder assembly according to claim 2 wherein said motor stator is fixed relative to said rudder plate and includes a stator shaft affixed at at least one end thereof to said rudder plate and wherein said motor rotor is arranged to be rotatable relative to said motor stator.

4. A rudder assembly according to claim 2 wherein said motor stator includes a stator shaft affixed to said rudder plate, said power supply means effecting power supply through said stator shaft.

5. A rudder assembly according to claim 4 further including slip ring means for effecting power supply for said electric motor to said motor rotor through said stator shaft.

6. A rudder assembly according to claim 2 wherein said motor stator includes a stator shaft having one end affixed to said rudder plate and wherein said rotor cylinder includes one end rotatively mounted to said rudder plate and an opposite end rotatively mounted on said stator shaft.

7. A rudder assembly according to claim 6 wherein said motor rotor is arranged to radially surround said motor stator.

8. A rudder assembly according to claim 2 wherein said motor rotor includes a rotor shaft, said assembly further including means rotatively mounting said rotor cylinder at a lower end thereof to said rudder plate, a fixed shaft affixed to said rudder plate having the upper end of said rotor cylinder rotatively mounted thereto, means rotatively supporting said rotor shaft on said fixed shaft and means fixedly mounting said rotor cylinder to the lower end of said rotor shaft, said motor stator being arranged to radially surround said motor rotor.

9. A rudder assembly according to claim 2 wherein said motor stator includes a stator shaft fixed at opposite ends thereof to said rudder plate and wherein said rotor cylinder is rotatively mounted on said stator shaft at points proximate said opposite ends thereof.

10. A rudder assembly according to claim 2 wherein said motor stator includes a stator shaft fixed relative to said rudder plate and wherein said rotor cylinder is arranged to enclose said electric motor internally thereof, said rudder assembly including watertight seal means for the interior of said rotor cylinder to prevent flooding of said electric motor.

11. In a rudder assembly for watercraft and floating equipment including a rudder plate and a rudder rotor mounted on said rudder plate, said rudder rotor including rotating external surface means, the improvement comprising that said rudder rotor is itself constructed as an electric motor to include components forming said rudder rotor as an underwater electric motor consisting essentially of a motor stator and a motor rotor operative to rotatively drive said rotating external surface means, said motor stator and said motor rotor being physically completely contained within the structure of said rudder rotor, said assembly further comprising power supply means extending externally of said rudder rotor for supplying power to drive said electric motor, and wherein the inner area of said rudder rotor is connected with a compressed air line.

12. In a rudder assembly for watercraft and floating equipment including a rudder plate and a rudder rotor mounted on said rudder plate, said rudder rotor including rotating external surface means, the improvement comprising that said rudder rotor is itself constructed as an electric motor to include components forming said rudder rotor as an underwater electric motor consisting essentially of a motor stator and a motor rotor operative to rotatively drive said rotating external surface means, said motor stator and said motor rotor being physically completely contained within the structure of said rudder rotor, said assembly further comprising power supply means extending externally of said rudder rotor for supplying power to drive said electric motor, and wherein the inner area of said rudder rotor can be blown out with compressed air from the outside via closable or non-closable openings.

13. In a rudder assembly for watercraft and floating equipment including a rudder plate and a rudder rotor mounted on said rudder plate, said rudder rotor including rotating external surface means, the improvement comprising that said rudder rotor is itself constructed as an electric motor to include components forming said rudder rotor as an underwater electric motor consisting essentially of a motor stator and a motor rotor operative to rotatively drive said rotating external surface means, said motor stator and said motor rotor being physically completely contained within the structure of said rudder rotor, said assembly further comprising power supply means extending externally of said rudder rotor for supplying power to drive said electric motor, and wherein a quantity of water is arranged in the inner area of the rudder, rotor above which a protective air bubble is formed for the electromotive parts (stator and rotor).

* * * * *